United States Patent [19]

Szloboda

[11] Patent Number: 4,622,937

[45] Date of Patent: Nov. 18, 1986

[54] VACUUM OPERATED APPARATUS FOR CONTROLLING THE IGNITION TIMING OF AN ENGINE

[76] Inventor: David T. Szloboda, 10640 Skagit Drive, Richmond, British Columbia, Canada, V7E 2A2

[21] Appl. No.: 719,729

[22] Filed: Apr. 4, 1985

[30] Foreign Application Priority Data

Dec. 13, 1984 [GB] United Kingdom ..... 8431521

[51] Int. Cl.[4] ..... F02P 5/12

[52] U.S. Cl. ..... 123/407

[58] Field of Search ..... 123/407, 408, 409, 525

[56] References Cited

U.S. PATENT DOCUMENTS

| | | | |
|---|---|---|---|
| 3,329,136 | 7/1967 | Cadiou | 123/407 |
| 3,478,729 | 11/1969 | Tada | 123/407 |
| 3,730,154 | 5/1973 | Vortanian | 123/409 |
| 4,399,780 | 8/1983 | Lassanske et al. | 123/525 X |

*Primary Examiner*—Tony M. Argenbright
*Attorney, Agent, or Firm*—Donald W. Meeker

[57] ABSTRACT

Vacuum operated apparatus for controlling the ignition timing of an engine, which apparatus comprises valve means and first, second, third and fourth conduit means, the valve means comprising a first chamber, first and second ports in the first chamber, first obturator means for opening and closing the second port, a second chamber, third and fourth ports in the second chamber, and second obturator means for opening and closing the fourth port, the first conduit means being for connecting the first port to an engine inlet manifold, the third conduit means being for connecting the third port to an engine carburetor, and the second and fourth conduit means being for connecting the second and fourth ports respectively to an engine distributor, and the apparatus being such that in use the valve means receives first vacuum forces from the inlet manifold via the first conduit means and second vacuum forces from the carburetor via the third conduit means, the valve means being operative to transmit the greater of the first and the second vacuum forces via the second and the fourth ports and the second and fourth conduit means to the engine distributor so that the engine distributor always receives the optimum vacuum force for causing the optimum adjustment of the engine distributor.

10 Claims, 6 Drawing Figures

VACUUM OPERATED APPARATUS FOR CONTROLLING THE IGNITION TIMING OF AN ENGINE

This invention relates to vacuum operated apparatus for controlling the ignition timing of an engine.

Since its beginning, the vehicle industry has been researching and experimenting in an endeavour to find better ignition timing systems for engines. Although electronic spark distributors have recently been developed, these distributors have met with little commercial acceptance and, at the present time, the advancing and retarding of a spark to give the required ignition timing is mostly achieved using well known mechanically operating distributors. The mechanically operating distributors are manually set to the basic ignition timing required by the engine. This basic ignition timing is then finely adjusted during engine operating conditions by utilising the variable vacuum that occurs in the carburettor of the vehicle. This variable vacuum is transmitted to the mechanically operating distributors and causes them to finely adjust the ignition timing consequent upon the engine operating conditions.

In recent years and due to fuel shortages and rising fuel costs, more and more people have been converting their vehicles to run on gaseous fuel instead of the usual liquid fuel such as gasolene. The gaseous fuel is sometimes known as liquid petroleum gas and it may be a liquid propane gas or natural gas. Other gaseous fuels may be employed. All the gaseous fuels give rise to a common problem that presents itself when the engine is converted from running on liquid fuel to gaseous fuel. The problem is especially acute where engines are modified such that they are capable of using either liquid fuel or gaseous fuel, depending upon which fuel is available. The problem is that liquid and gaseous fuels have different flashing points with liquid fuel having a lower flashing point than gaseous fuel. These different flashing points require different ignition timing for obtaining optimum engine performance, for example optimum engine power and/or optimum engine fuel consumption. Thus, for an engine that is to be converted from operating solely on liquid fuel to operating on liquid fuel or gaseous fuel as required, two separate ignition timing parameters are required, one to take in to account the lower flashing point of the liquid fuel and the other to take into account the higher flashing point of the gaseous fuel.

An attempt to meet the above problem has been made in the vehicle gas conversions industry, which is the industry that is currently employed in converting vehicles to run on gaseous fuel. The vehicle gas conversions industry refer to the requirement of a dual spark curve, and an electrical device has been developed to give this dual spark curve. The electrical device is expensive and it also requires considerably different installation on different makes of car. In view of the many available makes of car at present available, the installation instructions are complex and varied for different makes of car and very few mechanics know how satisfactorily to install the electronic device. This in turn has caused confusion and dissatisfaction amongst customers.

It is an aim of the present invention to provide a better device than the one referred to above.

Accordingly, this invention provides vacuum operated apparatus for controlling the ignition timing of an engine, which apparatus comprises valve means and first, second, third and fourth conduit means, the valve means comprising a first chamber, first and second ports in the first chamber, first obturator means for opening and closing the second port, a second chamber, third and fourth ports in the second chamber, and second obturator means for opening and closing the fourth port, the first conduit means being for connecting the first port to an engine inlet manifold, the third conduit means for being connecting the third port to an engine carburettor, and the second and fourth conduit means being for connecting the second and fourth ports respectively to an engine distributor, and the apparatus being such that in use the valve means receives first vacuum forces from the inlet manifold via the first conduit means and second vacuum forces from the carburettor via the third conduit means, the valve means being operative to transmit the greater of the first and the second vacuum forces via the second and the fourth ports and the second and the fourth conduit means to the engine distributor so that the engine distributor always receives the optimum vacuum force for causing the optimum adjustment of the engine distributor to give the optimum engine ignition timing during engine operating conditions.

The vacuum operated apparatus of the invention can be produced very cheaply. It may greatly increase fuel efficiency, increase engine power, and considerably reduce engine pollution emissions when the engine is operating on either a liquid fuel or a gaseous fuel.

Whereas the existing vacuum operated types of apparatus for controlling the ignition timing of an engine just rely on one vacuum source provided by the carburettor, the vacuum operated apparatus of the present invention uses two different vacuum sources, one being the vacuum source from the usual carburettor and the other being the vacuum source from the manifold. This is advantageous because if only one vacuum source from the carburettor is used, as in the known types of vacuum operated apparatus, there will be no or poor ignition timing adjustment at low engine revolutions per minute when there is either no vacuum or only a very small vacuum in the carburettor. The present invention utilises the fact that the vacuum in the manifold, for example, just below the carburettor, is highest at engine idling speed and it decreases with engine acceleration. With engine acceleration, the vacuum in the carburettor can then be used because with engine acceleration, the vacuum in the carburettor increases. Thus, the vacuum operated apparatus of the present invention utilises two variable vacuums from two vacuum sources, and the engine distributor can be fed with the greater of these variable vacuums to give the most advantageous ignition timing adjustment.

The first, second, third and fourth ports may be formed in first, second, third and fourth nipples respectively.

Preferably, the second and the fourth nipples extend into the first and the second chambers respectively.

The first and the second obturator means are each advantageously a flap operating obturator device.

The vacuum operated apparatus may be one in which the first and the second chambers are formed in a valve body which is in two parts, in which the flap operating obturator devices each have a peripheral portion which is trapped between the two parts of the body, and in which the flap operating obturator devices operate against each of the ends of the second and the fourth nipples that are in the first and the second chambers respectively.

Usually, the first conduit means will include a valve for opening or closing the first conduit means. This enables the vacuum from the manifold to be used or shut off as desired.

The valve for the first conduit means may be an electrically operated valve. A presently preferred electrically operated valve is a solenoid. Other types of valve including mechanically operating valves may be employed.

The vacuum operated apparatus preferably includes auxiliary air inlet means. The auxiliary air inlet means may be employed to eliminate any possibility of a vacuum lock occuring in the valve means and also to help ensure that there is no hesitation in the variation of the vacuum fed to the distributor whereby ignition adjustment such as spark advancement occurs smoothly and continuously.

The auxiliary air inlet means may be an air inlet port provided in the valve means. The air inlet port is advantageously provided in the part of the fourth nipple that extends into the second chamber.

An embodiment of the invention will now be described solely by way of example and with reference to the accompanying drawings in which.

Figure 1:
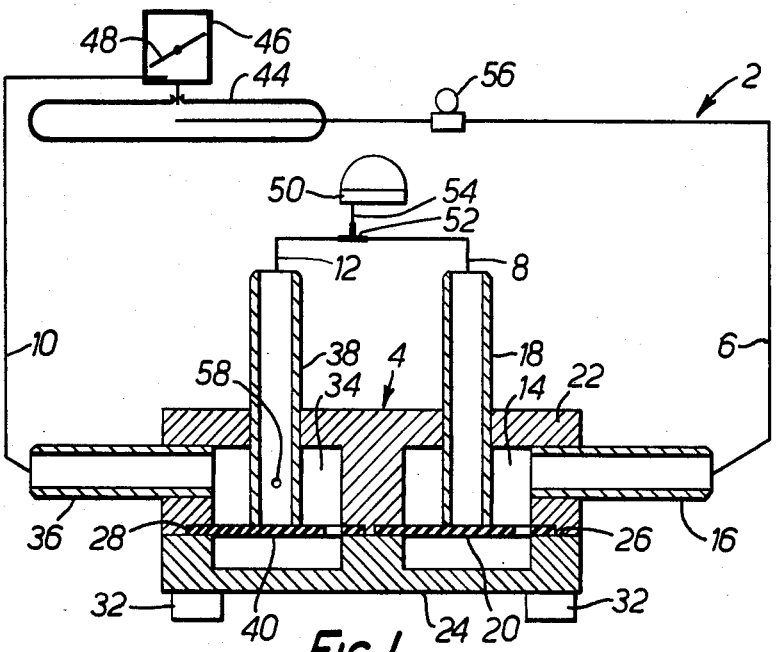
FIG. 1 shows vacuum operated apparatus for controlling the ignition timing of an engine.
Figure 2:
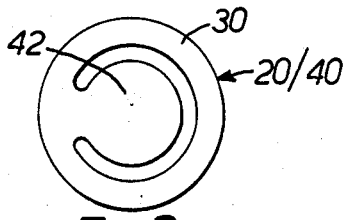
FIG. 2 shows in detail a first or a second obturator means as employed in FIG. 1.
Figure 3:
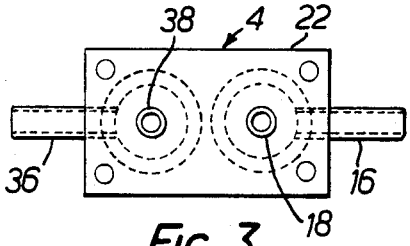
FIG. 3 is an top plan view of the valve means shown in FIG. 1.
Figure 4:
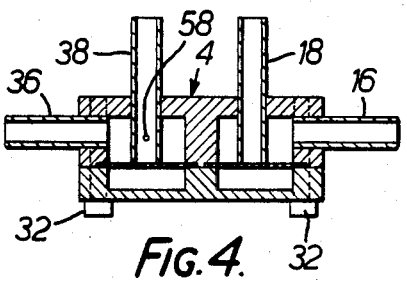
FIG. 4 is a cross section through the valve means.
Figure 5:
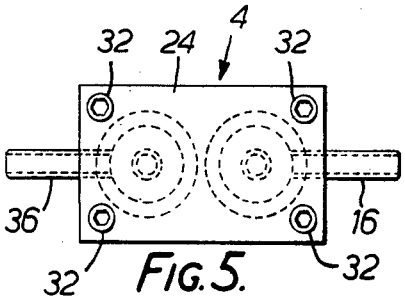
FIG. 5 is an underneath view of the valve means.

Referring to FIGS. 1 to 5, there is shown vacuum operated apparatus 2 for controlling the ignition timing of an engine. The apparatus 2 comprises valve means 4, a first conduit means 6, a second conduit means 8, a third conduit means 10, and a fourth conduit means 12.

The valve means 4 comprises a first chamber 14. This first chamber 14 has a first port in the form of a first nipple 16, and a second port in the form of a second nipple 18. The valve means also has first obturator means in the form of a flap operating obturator device 20 for opening and closing the end of the second nipple 18 that is in the first chamber 14.

The chamber 14 is provided in a valve body which is in two parts 22,24 as shown and these two parts 22,24 join together at a join line 26 shown in FIG. 1. The part 22 is provided with a recess 28 which houses the periphery 30 of the device 20. This periphery 30 then gets tightly sandwiched between the two parts 22,24 as they are fastened together, this fastening being by means of screws 32.

The valve means 4 also comprises a second chamber 34. The second chamber 34 has a third port in the form of a third nipple 36. The second chamber 34 also has a fourth port in the form of a fourth nipple 38. The fourth nipple 38 extends into its second chamber 34 similarly as the second nipple 18 extends into its first chamber 14. Second obturator means in the form of a flap operating obturator device 40 is provided for closing the end of the fourth nipple 38 as illustrated. The device 40 is the same as the device 20 illustrated in FIG. 2 and it will be seen that its periphery 30 is trapped in the recess 28 exactly the same as the device 20. In the drawing, the screws 32 are shown for simplicity with their heads proud of the part 24 but they will normally be counter sunk into the part 24. With the devices 20,40 trapped between the parts 22,24, the flap portion 42 of each device 20,24 is able to move up and down to block or open the ends of the nipples 18,38 that are in the chambers 14,34 respectively.

As shown in FIG. 1, the first conduit means 6 is used to connect the first nipple 16 to an engine inlet manifold 44 just below an engine carburettor 46. The third conduit means 10 is used to connect the third nipple 36 to the carburettor 46. As shown, the carburettor 46 is provided with the usual butterfly valve 48. The second conduit means 8 is used to connect the second nipple 18 to an engine distributor 50. Similarly, the fourth conduit means 12 is used to connect the fourth nipple 38 to the engine distributor 50. As shown in FIG. 1, the second conduit means 8 and the fourth conduit means 12 are connected together at a T-junction 52 and then they proceed as a single conduit 54 to the distributor 50.

As thus far described, it will be apparent that the vacuum operated apparatus 2 is such that in use the valve means 4 can receive first vacuum forces from the inlet manifold 44 via the first conduit means 6, and second vacuum forces from the carburettor 46 via the third conduit means 10. As will be described in greater detail hereinbelow the valve means 4 is operative to transmit the greater of the first and the second vacuum forces via the second and the fourth nipples 18,38 respectively and the second and the fourth conduit means 8,12 respectively to the engine distributor 50 so that the engine distributor 50 always receives the optimum vacuum force for causing the optimum adjustment of the engine distributor 50 to give the optimum engine ignition timing during engine operating conditions.

The first conduit means 6 is provided with a valve in the form of an electrically operated solenoid 56. The solenoid 56 is effective to open or close the first conduit means 6.

The valve means 4 is provided with auxiliary air inlet means in the form of an air inlet port 58. As shown in FIG. 1, the air inlet port 58 is provided in the part of the fourth nipple 38 that extends into the second chamber 34.

In operation of the vacuum operated apparatus 2, the solenoid 56 will normally be arranged to be activated synchronously with a gaseous fuel on/off switch (not shown) which will cause the engine to run on gaseous fuel instead of liquid fuel. When a single spark curve is required as when the engine is running solely on a liquid fuel such as gasoline, the solenoid 56 can be left open or can be omitted entirely from the vacuum operated apparatus 2.

When starting the engine, a very high vacuum will be produced in the inlet manifold 44. The idling speed of the engine should be readjusted accordingly. The vacuum from the manifold 44 passes along the first conduit means 6 and reaches the first nipple 16. The vacuum passes into the first chamber 14 and opens the flap portion 42 of the device 20. The device 20 will normally be made of rubber so that it will be appreciated that the flap portion 42 just pivots downwardly from the position shown in FIG. 1. The vacuum from the manifold 44 then passes along the second nipple 18, the second conduit means 8, the fourth conduit means 12 and the fourth nipple 38 to lift the flap portion 44 of the device 40 and to thus close the fourth nipple 38. This will be effective to shut off the lower vacuum source that comes to the fourth nipple 38 from the carburettor 46 via the third conduit means 10 and the third nipple 36. With the device 40 shutting the fourth nipple 38, a very slight loss of vacuum will occur through the air inlet port 58. This port is very small and is preferably 0.016" (0.4 mm) diameter. With the device 40 shutting the fourth nipple 38, one of the functions of the valve means 4 is completed. The vacuum will accumulate and according to its variable intensity, it will cause the distributor 50 to operate to advance the spark in the engine.

The intensity of the vacuum in the manifold 44 decreases in inverse proportion to the acceleration of the engine. The vacuum from the carburettor 46 increases in direct proportion to the acceleration of the engine, whilst retaining its variance according to torque requirements. As the vacuum increases in the carburettor 46, any slight increase in this vacuum will be felt along the third conduit means 10 and the third nipple 36. This will cause the device 40 to open since the increased vacuum in the second chamber 34 will suck the flap portion 42 downwardly as shown in FIG. 1. The vacuum from the carburettor 46 will then pass via the fourth nipple 38, the fourth conduit means 12, the second conduit means 8 and the second nipple 18 to the device 20. The suction will cause the flap portion 42 to pivot upwardly to close the second nipple 18. Thus, the distributor 50 will then be receiving vacuum forces from the carburettor 46 instead of from the manifold 44. The carburettor 46 will thus effectively have taken over the control of the distributor 50 to effect the required spark advancing function. This thus completes another of the functions of the valve means 4 and this will have been done without any vacuum leakage through the air inlet port 58.

During the operation of the valve means 4, there may be times when the vacuums from the two sources of the inlet manifold 44 and the carburettor 46 may be in perfect balance and this may eliminate the difference needed for spark advancement via the distributor 50. The air inlet port 58 is then effective to come into operation if the devices 20,40 should simultaneously be in their closed position. The air inlet port 58 is thus effective to eliminate any vacuum lock in the valve means 4, it avoids any substantial hesitation in the variation of the vacuum applied to the distributor 50, and it enables the smooth continuous advancement of the spark as required by engine requirements.

It will be appreciated that the valve means 4 operates as a flip flop logic check valve. Substantially no force is required to operate the valve means 4 and the entire vacuum operated apparatus 2 may be used for single or dual curve spark advancement. The vacuum operated apparatus 2 can be used for substantially any vacuum spark advancement system, whether the system requires liquid or gaseous fuel. The vacuum operated apparatus 2 can be installed without costly changes being required to the engine of the vehicle. As mentioned above, the vacuum operated apparatus 2 may be effected to increase the horsepower of the engine and also to reduce fuel consumption.

Figure 6:
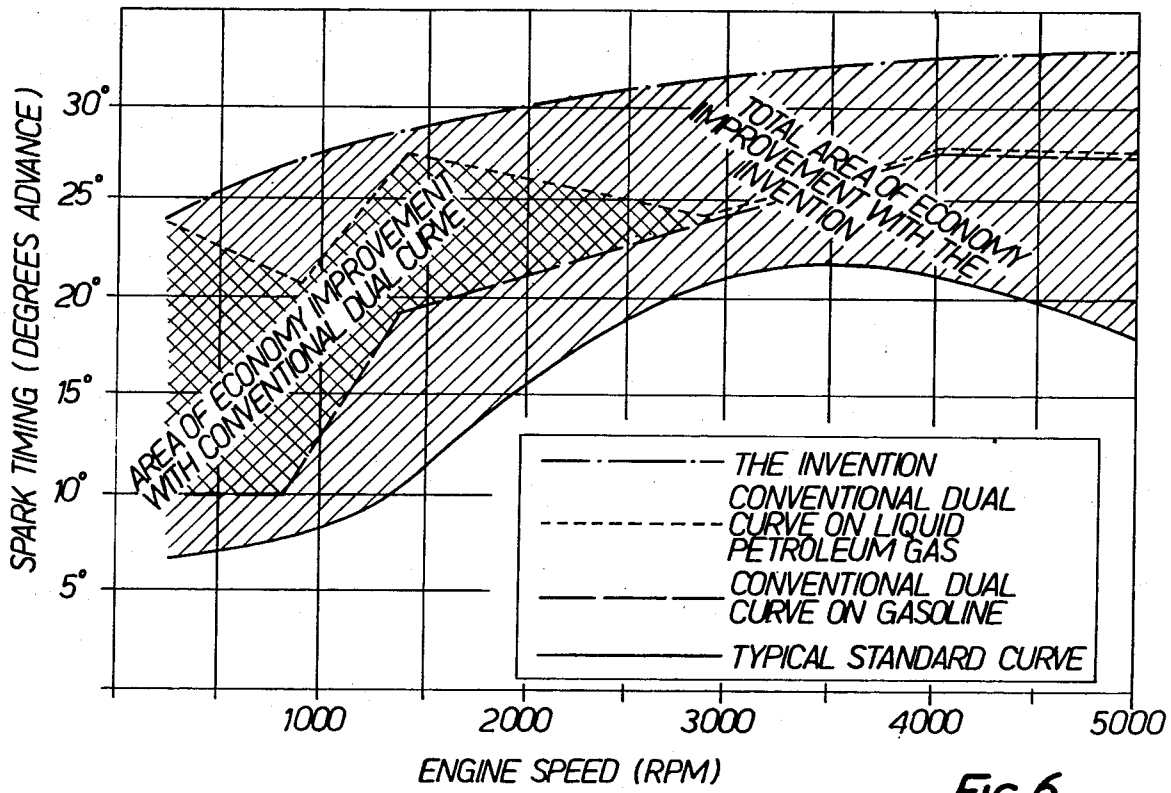
FIG. 6 shows a graph illustrating the area of improvement of an engine employing the vacuum operated apparatus.

Referring now to FIG. 6, there are shown several graphs of spark timing (degrees advance) against engine speed (revolutions per minute). The area of improvement afforded by the vacuum operated apparatus 2 is clearly shown.

It is to be appreciated that the embodiment of the invention described above has been given by way of example only and that modifications may be effected. Thus, for example, a different type of first and second obturator means may be employed to the flap operating obturator devices 20, 40. Also, rivets can be used instead of screws or bolts 32.

The vacuum operated apparatus 2 may be made in various different ways. Thus, for example, it may be made on a punch press using sheet metal, with the various parts being locked together by folding the sheet metal. Alternatively, the vacuum operated apparatus 2 can be produced in two separate substantially identical pieces which are then joined together. The vacuum operated apparatus 2 can be made from various materials so that, for example, it can be die cast from an aluminium alloy or injection moulded from a plastics material.

The vacuum operated apparatus 2 can be used on its own for modifying engines as described above. The vacuum operated apparatus 2 is however, especially advantageous when it is used in conjunction with the devices described and claimed in my U.S. Pat. No. 4,386,594 and U.S. patent application Ser. No. 626,159 which describe and claim systems for enabling engines to operate on liquid fuel or gaseous fuel as may be required by a driver of a vehicle.

What is claimed is:

1. Vacuum operated apparatus for controlling the ignition timing of an engine, which apparatus comprises valve means and first, second, third and fourth conduit means, the valve means comprising a first chamber, first and second ports in the first chamber, first obturator means for opening and closing the second port, a second chamber, third and fourth ports in the second chamber, and second obturator means for opening and closing the fourth port, the first conduit means being for connecting the first port to an engine inlet manifold, the third conduit means being for connecting the third port to an engine carburettor, and the second and fourth conduit means being for connecting the second and fourth ports respectively to an engine distributor, and the apparatus being such that in use the valve means receives first vacuum forces from the inlet manifold via the first conduit means and second vacuum forces from the carburettor via the third conduit means, the valve means being operative to transmit the greater of the first and second vacuum forces via the second and fourth ports and the second and fourth conduit means to the engine distributor so that when the engine is started or idling, the first vacuum force passes from the engine inlet manifold along the first conduit means and the first port into the first chamber, thereby opening the first obturator means, the first vacuum force then passes along the second port, the second conduit means and the fourth conduit means, closing the second obturator means to close the fourth port causing the first vacuum force to accumulate and, according to its variable intensity, to cause the engine distributor to operate to advance the spark of the engine; as the engine is accelerated, the second vacuum force increases in the carburettor, any slight increase in this second vacuum force will be felt along the third conduit means and the third port which will cause the second obturator means to open due to the increased vacuum in the second chamber, the second vacuum force then passes via the fourth port, the fourth conduit means, the second conduit means and the second port, closing the first obturator means causing the first obturator means to close the second port thus the distributor will then be receiving vacuum forces from the carbutettor instead of the manifold, therefore the engine distributor always receives the optimum vacuum force for causing the optimum adjustment of the engine distributor to give the optimum engine ignition timing during engine operating conditions.

2. Vacuum operated apparatus according to claim 1 in which the first, second, third and fourth ports are formed in first, second, third and fourth nipples respectively.

3. Vacuum operated apparatus according to claim 2 in which the second and the fourth nipples extend into the first and the second chambers respectively.

4. Vacuum operated apparatus according to claim 3 in which the first and the second obturator means are each a flap operating obturator device.

5. Vacuum operated apparatus according to claim 4 in which the first and the second chambers are formed in a valve body which is in two parts, in which the flap operating obturator devices each have a peripheral portion which is trapped between the two parts of the body, and in which the flap operating obturator devices operate one against each of the ends of the second and the fourth nipples that are in the first and the second chambers respectively.

6. Vacuum operated apparatus according to claim 5 in which the first conduit means includes a valve for opening or closing the first conduit means.

7. Vacuum operated apparatus according to claim 6 in which the valve is an electrically operated valve.

8. Vacuum operated apparatus according to claim 5 and including auxiliary air inlet means.

9. Vacuum operated apparatus according to claim 8 in which the auxiliary air inlet means is an air inlet port provided in the valve means.

10. Vacuum operated apparatus according to claim 9 in which the air inlet port is provided in the part of the fourth nipple that extends in to the second chamber.

* * * * *